United States Patent [19]

Waxman

[11] 4,051,406

[45] * Sept. 27, 1977

[54] ELECTRONIC STORAGE TUBE TARGET HAVING A RADIATION INSENSITIVE LAYER

[75] Inventor: Albert S. Waxman, Santa Clara, Calif.

[73] Assignee: Princeton Electronic Products, Inc., North Brunswick, N.J.

[ * ] Notice: The portion of the term of this patent subsequent to Feb. 24, 1993, has been disclaimed.

[21] Appl. No.: 616,125

[22] Filed: Sept. 24, 1975

Related U.S. Application Data

[63] Continuation of Ser. No. 430,257, Jan. 2, 1974, abandoned.

[51] Int. Cl.[2] ..... H01J 29/41; H01J 31/08

[52] U.S. Cl. ..... 313/391; 313/392

[58] Field of Search ..... 313/367, 391, 392, 395, 313/398, 367

[56] References Cited

U.S. PATENT DOCUMENTS

| | | | |
|---|---|---|---|
| 3,284,652 | 11/1966 | Yaggy | 313/398 |
| 3,480,482 | 11/1969 | Picker | 313/395 |
| 3,523,208 | 8/1970 | Bodmer et al. | 315/10 |
| 3,564,309 | 2/1971 | Hoeberechts et al. | 313/367 |
| 3,631,294 | 12/1971 | Hofstein | 315/12 R |
| 3,646,391 | 2/1972 | Hofstein | 315/12 R |
| 3,885,189 | 5/1975 | Picker et al. | 313/366 X |
| 3,940,651 | 2/1976 | Hofstein | 313/391 |
| 3,949,264 | 4/1976 | Hofstein | 313/391 X |

*Primary Examiner*—Robert Segal

*Attorney, Agent, or Firm*—Ostrolenk, Faber, Gerb & Soffen

[57] ABSTRACT

A target for electronic storage tubes of the non-direct viewing type having a target comprised of substantially coplanar insulating and conducting areas wherein the insulating area is provided on one face of the conducting area in a predetermined and preferably striped pattern. The insulating pattern is comprised of at least a layer of ionizing radiation insensitive material taken from the group of materials comprised of silicon nitride, silicon oxynitride, aluminum oxide.

8 Claims, 10 Drawing Figures

ELECTRONIC STORAGE TUBE TARGET HAVING A RADIATION INSENSITIVE LAYER

This is a continuation of Application Ser. No. 430,257, filed Jan. 2, 1974 now abandoned.

The present invention relates to electronic storage tubes of the electronic output signal type and more particularly to a novel target for electronic storage tubes employing an insulating pattern comprised of at least one layer of a material which is insensitive to ionizing radiation.

BACKGROUND OF THE INVENTION

Electronic storage tubes fall into several general categories, including the light outputor direct view storage tube and the electrical output type typically used in conjunction with standard cathode ray tubes for viewing stored images.

A preferred form of electronic output signal storage tube is the so called "beam current reading" type tube (see B. Kazan & M. Knell, "Electronic Image Storage" pp. 123–129, Academic Press 1968) employing a target comprised of a conductive layer and a substantially coplanar insulating layer arranged in a predetermined pattern upon the conductive layer which preferably is a striped pattern. One suitable tube structure is disclosed in U.S. Pat. No. 3,631,294 dated Dec. 28, 1971 and incorporated herein by reference thereto. The present invention constitutes an improvement of the aforementioned U.S. Patent.

The physics of image storage is such that the magnitude of the negative charge on the surface of the insulating layer controls the amount of the beam which reaches the conductive layer. This is exactly analogous to the mechanism of controlling the current flow to the plate in a vacuum tube triode by means of a negative voltage on the control grid. The image formed on the target is stored as a negative charge pattern on the confronting surface of the insulation material. During readout, the insulation surface of the target is at a potential which is everywhere negative relative to the cathode of the storage tube, so that no beam current lands upon the insulation pattern (which may be analogized to the control grid of a vacuum triode, which draws no current since it is at a negative potential relative to the cathode). Thus, image readout is non-destructive in the electron storage tube and the image is retained in the form of the charge pattern formed upon the insulation material during a write mode enabling many reading operations to be performed without destroying the image.

Although some present-day devices to exhibit relatively good image retention times, experimentation still continues in an effort to improve retention time to enable electronic storage tubes to be utilized in applications in which conventional storage tube retention times have been proven to be unsatisfactory.

The electron beam from a vidicon or CRT type gun typically used in a storage tube possesses a beam landing characteristic typified in FIG. 1*a* wherein the curve A thereon shows target current $I_T$ as a function of target voltage $V_T$. FIG. 1*b* shows a typical vidicon type gun structure 1 having control grid G1, acceleration grids G2 and G3, deceleration grid G4, cathode K and target T having a target voltage $V_T$ coupled thereto.

$I_{max}$ is a function of G1 and G2 voltage while the G3 and G4 voltages determine such factors as beam focus and uniformity of landing on the target (i.e. shading). It can be seen that target current $I_T$ increases with increasing target voltage $V_T$ until it reaches a maximum value $I_{max}$ after which a drop in the curve occurs due to increasing secondary emission from the target.

The present invention is concerned with electronic output signal storage tubes of the beam current control reading type in which the target is comprised of a pattern of conductive and insulating regions where the conducting regions are connected together and the insulating regions form a "coplanar grid" capable of developing and retaining an electron charge pattern which controls target current to the conducting regions during a read mole in which a conventional scan of an unmodulated electron beam sweeps the target.

In structures of the latter type two of the most significant characteristics are erase time and retention time. Erase time is that time required to "erase" an image so that the target, when swept by an unmodulated electron beam during a typical scanning operation as would be performed during a read mode, will create a totally "black" image. In other words, the target, after erasure, should have its "coplanar grid" provided with a charge pattern which prevents the electron beam from striking the target conducting surface and which develops a uniformly black picture. It is desirable to have erasure time reduced to as low a value as possible in order to permit usage of the electronic storage tube in a wide variety of high-speed applications.

Retention time refers to the ability of an electron storage tube of the latter type to retain an image created thereon regardless of whether the electron storage tube is turned off or has undergone a repeated number of read operations. As retention time with the beam off has been found to be quite long (usually of the order of one week or more) when the electron storage tube is turned off, it has nevertheless been found that the image will fade after repeated read operations.

BRIEF DESCRIPTION OF THE INVENTION

A primary object of the present invention is to develop targets for electron storage tubes which are capable of providing significant improvements in both reduced erasure time and increased retention time.

In electronic storage tubes having coplanar grid type targets employing a silicon conducting layer having a copolanar grid of silicon dioxide, it has been discovered that retention time is affected by the sensitivity of the insulation (silicon dioxide) layer ionizing radiation such as x-radiation which is caused by inpact of the electron beam with the deceleration grid mesh such as grid $G_4$ in FIG. 1*b*. The radiation causes the silicon dioxide to exhibit an increased amount of conductivity whereby the charge developed on the surface thereof confronting the electron beam is transferred or "leaked" to the conducting layer.

The above observations have led to the development of a copolanar grid type target having at least one layer of insulation material which is substantially insensitive to ionizing or x-radiation so as to significantly reduce charge leakage in the presence of such radiation and thereby significantly increase retention time. Target structures which have been found to be extremely satisfactory in this regard consist of a silicon conducting layer having a pattern of radiation insensitive material such as, for example, silicon nitride, aluminum oxide or silicon oxy-nitride as the coplanar grid structure. These materials have been found to significantly enhance image retention time. In another alternative embodiment, a pattern of an insulation material having a lower dielectric constant such as, for example, silicon dioxide, has been deposited upon the radiation insensitive layer to significantly reduce the absolute capacitance of the coplanar grid structure and thereby enhance retention time as well as providing a signficant improvement in image erasing time.

BRIEF DESCRIPTION OF THE FIGURES

The above as well as other objects of the present invention will become apparent when reading the accompanying description and drawings in which.

DETAILED DESCRIPTION OF THE FIGURES

Figure 1A:
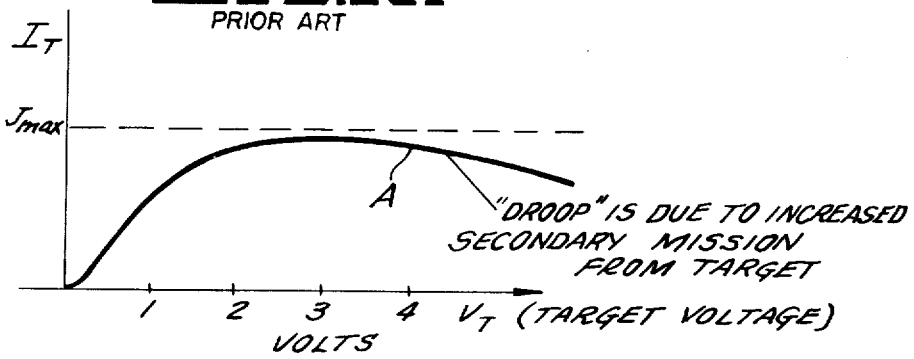
FIG. 1a PRIOR ART
FIG. 1*a* is a plot showing the relationship between target surface voltage and target current for electron tubes of the vidicon gun type.
Figure 1B:
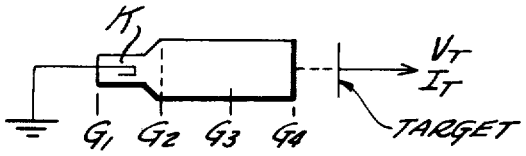
FIG. 1b PRIOR ART
FIG. 1*b* shows a typical storage tube gun structure.
Figure 2A:
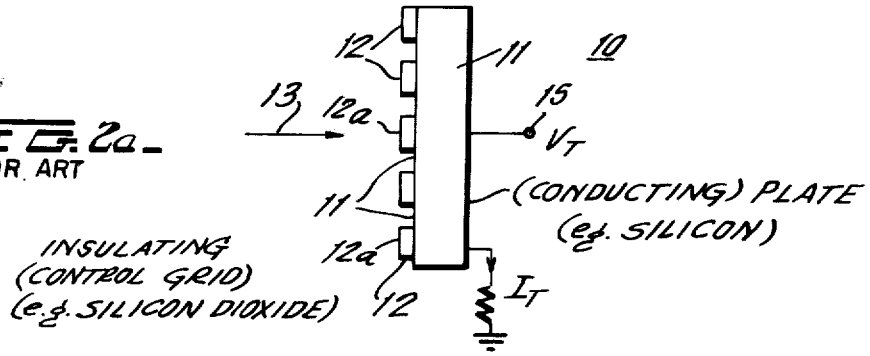
FIG. 2a PRIOR ART
FIG. 2*a* shows a target structure of the type employed in electronic storage tubes of the electron beam modulated type.

Whereas many different types of electronic storage tube targets are in existence, one of the most successful type developed to date utilizes beam current control reading with a coplanar grid type target. FIG. 2*a* shows cross sectional view of the coplanar grid target 10 which is comprised of a conducting plate 11 preferably formed of silicon and having layer 12 formed of an insulating material, preferably silicon dioxide, and arranged in a striped pattern.

The physics of image generation is such that a negative charge on the surface of the insulating areas 12 controls the amount of the electron beam 13 which reaches the exposed surface areas 11*a* of the conducting plate 11. This is exactly analogous to the operation of a vacuum tube triode whose control grid, which is typically negative relative to its cathode, controls the current flow to the anode with the magnitude of anode current being a function of the instantaneous potential applied to the control grid. The particular image formed on the target assemply 10 is stored as a negative charge pattern on the surfaces 12*a* of the insulating material. Since (as will become more obvious hereinbelow) the oxide surface potential is everywhere negative relative to the electron beam cathode, no beam current lands on the surfaces 12*a*. This is again analogous to the vacuum tube triode in which no current is drawn by the control grid due to its negative potential relative to the cathode. Thus the image readout in an electronic tube storage target of the type shown in FIG. 2*a* is nondestructive and has the advantageous characteristic of permitting many repetitive readout operations without severely impairing the image or pattern stored on the target.

Figure 2B:
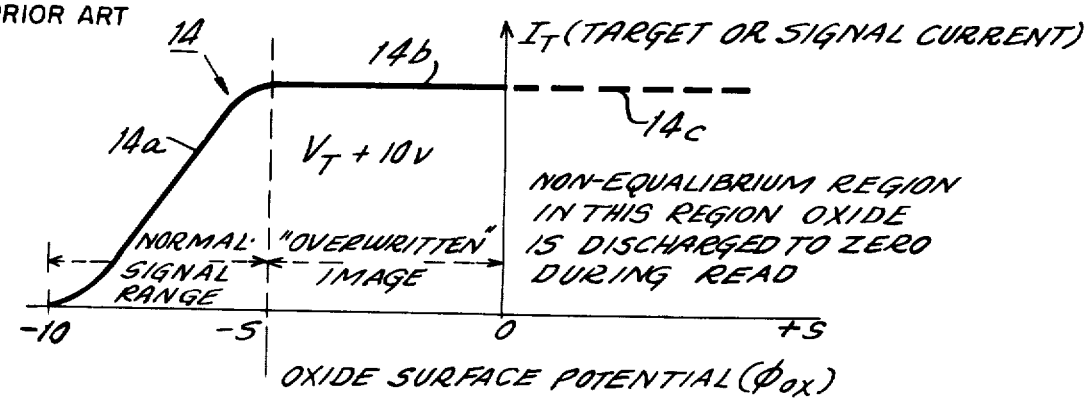
FIG. 2b PRIOR ART
FIG. 2*b* shows a curve of target current $I_T$ as a function of surface potential of the coplanar grid.

By way of example, a typical operating curve for the target of FIG. 2*a* is shown in FIG. 2*b*. Curve 14 represents the relationship between the oxide surface potential $\phi_{ox}$ and the target or signal current $I_T$ developed by the conducting layer 11 when the target conducting terminal has a voltage $V_T$ of +10 volts applied to its terminal 15. It can be seen that when the target voltage is +10 volts and the insulating surface potential is −10 volts (or less) that the target current is 0 (amps). This is due to the face that the negative surface charge acts in the same manner as the control grid of a vacuum triode to prevent the electron beam from striking the exposed surfaces 11*a* of the conductive member 11. Portion 14*a* of curve 14 which extends between the value −10 volts and −5 volts, and constitutes the normal signal range, shows that the repelling affect of the insulating surface potential diminishes to allow more and more electrons to strike exposed surfaces 11*a* of the targets and thereby generate a target current $I_T$ of continuously increasing magnitude. Curve portion 14*b* which extends between −5 volts and 0 volts and is typically referred to as the "over-written" image region, indicates that as the surface potential of the insulation stripes 12 increases from −5 volts toward 0 volts, this has no effect upon target current $I_T$ which is at $I_{max}$. Section 14*c* of curve 14 which extends from 0 volts toward +5 volts is generally referred to as the non-equilibrium region. In this region the insulating layer surface potential, being more positive than the electron gun cathode, begins to drawn electrons thereto and thus becomes more negative and is ultimately discharged to zero during scanning by the electron beam. This is an undesirable situation since the image is destroyed or severely impaired as a result.

An electron storage tube employing a target of the coplanar grid type has three basic modes, namely the erase mode, the write mode and the read mode which function in the following manner:

ERASE MODE

The target is considered erased when there is a uniform surface potential $\Phi_{ox}$, which is sufficiently negative to prevent any beam current from reaching the exposed surfaces 11*a* of the conducting layer 11.

Thus $\Phi_{oxE}$ = oxide surface "erase" potential = $\Phi_{ox/IT}$ = 0.

Figure 3A:
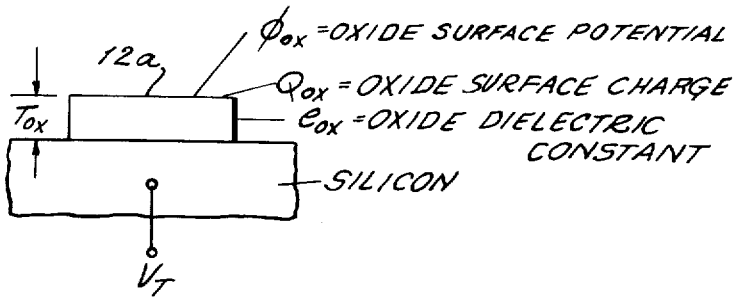
FIG. 3a PRIOR ART
FIG. 3*a* shows a detailed sectional view of a portion of the target structure of FIG. 2*a*.
Figure 3B:
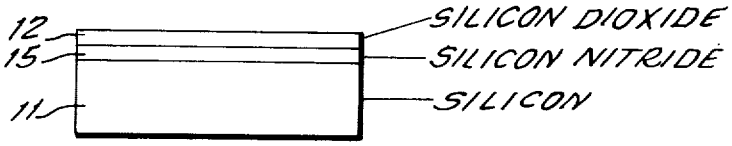
FIGS. 3*b* through 3*f* show target structures embodying the principles of the present invention and which are useful in describing the method steps employed in forming target structures of this type.

In order to perform an erasure operation it is necessary to place a negative charge upon the surface of the insulating layer. FIG. 3*a* shows a sectionalized portion of a target and indicates the terms which will serve to facilitate an understanding of the erasure operation. As shown in FIG. 3*a* $V_T$ represents the target voltage applied to the silicon (i.e. conducting) layer; $\Phi_{ox}$ represents the surface potential of the silicon dioxide (i.e. insulating layer); $Q_{ox}$ represents the surface charge on the surface 12*a* of the silicon dioxide; $\epsilon_{ox}$ represents the dielectric constant of the silicon dioxide layer; and $T_{ox}$ represents the thickness of the silicon dioxide layer.

The insulating layer in actuality functions as a miniature capacitor in which $$C_{ox} = \text{capacitance of } SiO_2 \text{ layer} = \epsilon_{ox}/T_{ox} \text{ and } \Phi_{ox} = Q_{ox}/C_{ox}$$

To perform an erase operation, the target potential $V_T$ is raised to a positive value, typically +20 volts, and the electron beam scans the confronting surface of the target by suitable X and Y deflection means in such a manner as to discharge the surface down to the cathode potential which is referenced at 0 volts. Upon completion of the discharge operation the potential difference between the surface potential $\Phi_{ox}$ and the conductive layer (which is still at +20 volts) is 20 volts and the surface potential (i.e. stored charge) is substantially uniform across the target. The target voltage $V_T$ is then lowered to its "read" value causing the insulating layer, which functions as a miniature capacitor, to have its surface potential $\Phi_{ox}$ drop by an identical amount to $\Phi_{oxE}$. Typically for a read voltage of +10 volts, $\Phi_{ox}$ will therefore drop to −10 volts.

The value of the insulating surface potential required to achieve erase is determined by the silicon target voltage in the "read" mode and the percentage of target area occupied by the insulation material.

If we define $A_{ox}'$ = normalized silicon dioxide area then, to a good approximation $\Phi_{oxE} \approx V_{TR}(1/A_{ox}' - 1)$ As an example, considering the plot of FIG. 2a, it is shown that the silicon dioxide surface potential is in the erased condition (i.e. $I_T$ equals 0) when the surface potential is −10 volts and the target voltage (in the read mode) is +10 volts This readily yields an implied value for the normalized oxide area of $A_{ox}' - 0.5$.

In typical electron storage tubes the insulation material "ratio" may vary from $A_{ox}' = 0.25$ to 0.5 with 0.3 being the most common value. Thus for a +10 volt target voltage in the read mode, the silicon dioxide surface potential will vary from −10 volts to −20 volts.

It should be noted thaat to achieve a silicon dioxide erased potential of $\Phi_{oxE}$ it is necessary to apply a target voltage during erasure operation of $V_{TE} = V_{TU} - \Phi_{oxE}$.

Hence, for the above example, $V_{TE}$ falls in the range from +20 to +30 volts.

WRITE OPERATION

In order to "write" on a target it is necessary to remove the negative charge from an erased area. This is accomplished by raising the target voltage $V_T$ during "writig" to such a high voltage level that secondary emission from the insulation surface causes more electrons to be "knocked out" of the insulating surface and thereby have more electrons leave the surface than land. Typically, the "crossover" point for silicon dioxide, at which point many more electrons are being "knocked off" and leaving the surface as are landing occurs at a value for $\Phi_{ox}$ which is approximately +25 bolts. To ensure uniform secondary emission over the target surface during writing, $V_{TW}$ = target write voltage) is set to a value at least above +70 volts and more usually to a value greater than +100 volts.

The gray scale of the written image is usually achieved by varying the beam current during writing to achieve the desired range of $\Phi_{ox}$ as is shown by the curve section 14a in FIG. 2b. Thus the nature of the charge pattern is such that the "whiter" areas of the image will be represented by a more positive surface potential on the insulating layer and, conversely, the "darker" areas will be represented by the more negative surface potential as can clearly be seen from the upper and lower extremities of curve section 14a.

READ PHENOMENA — RETENTION TIME VERSUS ERASE TIME

Erase time is defined as the time required to erase an image and is determined by the electron beam current and the target capacitance. A high beam current and low target (i.e. silicon dioxide) capacitance will minimize the time required to discharge the stored image. Other factors such as beam capture efficiency, which is related to $A_{ox}'$, and beam energy distribution, will not be considered at this time.

RETENTION TIME

Since the silicon dioxide surface potential is more negative than the cathode potential of the electron beam, the silicon dioxide does not absorb any beam current during the read operation. Although the stored image is nondestructive in terms of beam landing, other factors cause the image to fade. One well-known factor is the effect of positive gas ions. Just as in the case of gas generated "grid-leak" currents which occur in vacuum tube triodes, positive gas ions generated by collision of the beam with residual gas molecules are attracted to and land upon the negatively charged surface of the silicon dioxide. This causes the surfaces potential to slowly drift upwardly toward the 0 volt level. In other words, an erased, or black region will slowly fade toward white. The rate at which the gas ion current fades the image toward white depends also on the ionizing beam current as well as the target capacitance. The higher the target capacitance, the lower will be the image fade rate and the greater the image retention time.

In practical usage, however, it is desirable to minimize erase time while maximizing retention time. In this respect the "quality factor" K is defined is defined as $$K = (\text{retention time}/\text{erase time})$$

Although changing target capacitance (for example by changing the thickness of the silicon dioxide layer) represents a means of increasing or decreasing retention time and erase time, these values change proportionately while the quality factor K does not.

Detailed experimentation has been undertaken using silicon dioxide-silicon target structures in electronic storage tubes in an attempt to determine the relationship between the image retention time of the target and residual gas in the tube. It has been found that gas ion currents in electronic storage tubes cannot be satisfactorily related to the observed image retention time since the ion currents are 1 to 2 orders of magnitude too low to be considered as the cause of deterioration in image retention time. Taking this observed data into consideration together with several other experiments, it has been convincingly demonstrated that the cause of image fading during reading is the result of conductivity of the silicon dioxide which condition is induced by x-radiation generated by the electron beam impact with the deceleration grid mesh.

These observed phenomena have led to the development of a novel approach of using an insulation material, which is substantially radiation insensitive, as the coplanar grid structure.

The observed phenomena have led to the consideration of insulation materials such as silicon nitride and aluminum oxide which are known to be significantly more immune to the effect of ionizing radiation than silicon dioxide and as a result have been employed as a radiation immune material in transistor fabrications.

An example of a fabrication technique for electronic storage tube targets employing silicon as the conducting substrate and silicon nitride as the insulator is described hereinbelow in connection with FIG. 3d:

A polished silicon wafer 11 is coated initially with a layer of silicon nitride 15 which in turn is coated with a layer of silicon dioxide 12. A typical chemical vapor deposition process for the silicon nitride is silane ($SH_4$) plus ammonia ($NH_3$) which is placed in a hydrogen carrier at a temperature level of 1,000° C. The process used for developing the silicon dioxide layer consists of placing silane ($SH_4$) plus $CO_2$ in a hydrogen carrier at a temperature level of 1,000° C.

Figure 3C:
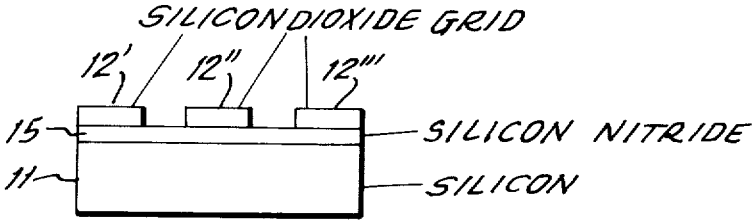

A pattern of photoresist strips are formed on the silicon dioxide layer which is then etched in buffered HF etchant to produce a silicon dioxide grid pattern of elongated substantially spaced parallel stripes 12', 12'', 12''', . . . . upon the surface of the silicon nitride as shown in FIG 3c.

The photoresist layer deposited upon the silicon dioxide layer is then removed after the etching operation. The above-described silicon dioxide grid forming process is substantially similar to that used in producing standard targets of the silicon dioxide-silicon type.

Figure 3D:
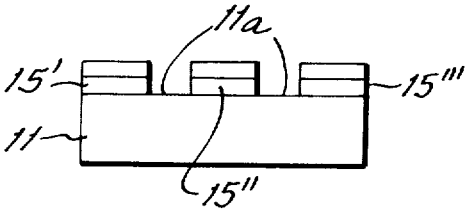

Employing the silicon dioxide as a mask, the silicon nitride layer is etched through the employment of hot phosphoric acid to form silicon nitride stripes 15', 15'', 15''', . . . . to thereby expose the intervening surface areas 11*a* of silicon 11 as shown in FIG. 3*d*.

Figure 3E:
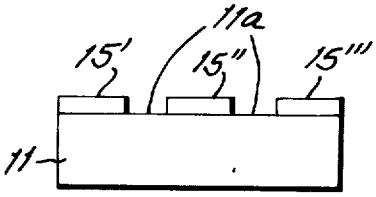
Figure 3F:
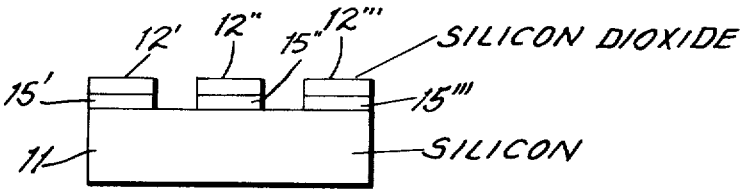

The silicon dioxide layer may then be removed through the use of hydrofluoric acid for example to yield a "coplanar grid" type structure as shown in FIG. 3*e* comprised of conductive silicon 11 having a striped pattern of silicon nitride stripes 15', 15'', . . . . with intervening exposed surface areas 11*a* of the silicon being positioned between adjacent pairs of the insulating stripes.

Whereas the above-described embodiment refers specifically to employment of silicon nitride, it should be understood that a similar methodology may be employed for forming a pattern of the type shown utilizing aluminum oxide or other radiation insensitive insulation materials.

One of the problems encountered with structures of the type shown in FIG. 3*e* is the limitation on maximum thickness of the silicon nitride or aluminum oxide films which are deposited in accordance with present technology, which also include techniques other than chemical vapor deposition such as vacuum sputtering and which are limited to forming layers of less than 0.3 $\mu$M. Films of thicknesses greater than 0.3 $\mu$M produce stress-induced cracking of the film. Since the dielectric constants of the above-mentioned materials are several times higher than that of silicon dioxide, this factor together with the thickness limit of 0.3 $\mu$M for silicon nitride combine to produce very high capacitance targets. Thus, although retention time and the quality factor K defined hereinabove are greatly improved, the high absolute value of the erase time encountered in structures of the type shown in FIG. 3*e* is too great to permit these structures to be employed in many electron storage tube applications. In addition, the high capacitance slows the writing speed of the target to the point where it can no longer be used for frame store, i.e. full target area writing in one TV frame time (30ms).

These limitations on application of structures of the type shown in FIG. 3*e* have led to the development of a composite structure utilizing radiation resistant material combined with one or more layers of low capacitance insulation materials which may or may not be radiation sensitive. For example, one such structure is shown in FIG. 3*d* as being comprised of conductive silicon 11 having silicon nitride deposited thereon in the form of a striped pattern (see 15' et al) and having silicon dioxide deposited upon the silicon nitride in the form of similarly arranged striped pattern (see the stripes 11' et al). This structure can be realized, for example, by using the fabrication technique described hereinabove while eliminating the process step employed for the removal of the silicon dioxide.

The silicon nitride in the arrangement of FIG. 3*d* provides good radiation immunity whereas the silicon dioxide layer significantly reduces capacitance resulting in a net improvement in the quality factor K while at the same time achieving a lower absolute value for target capacitance. The conduction of charged particles from the silicon dioxide stripes 11' et al toward the conducting silicon 11 is retarded by the intervening layers of silicon nitride 15' et al.

As another alternative embodiment and in an effort to achieve the dual goal of low capacitance combined with good radiation immunity, a structure of a composite material such as for example silicon oxy-nitride has been developed. The silicon nitride, as is mentioned hereinabove may be deposited upon the conducting silicon using silane ($SH_4$) reacted with ammonia ($NH_3$) and silicon dioxide can be deposited thereon by reacting silane with carbon dioxide ($CO_2$). Reacting silane with a mixture of ammonia plus carbon dioxide results in the deposition of the compound material i.e. silicon oxy-nitride. This pattern yields a coplanar grid type target whose retention time is significantly increased due to its substantial immunity to x-radiation while the composite material exhibits a substantially reduced capacitance as compared with silicon nitride or aluminum oxide layers resulting in an improvement of both erase time and retention time.

It can be seen from the foregoing description that the present invention provides a novel coplanar grid type target structure for use in electronic storage tubes and which exhibit all the advantages of conventional coplanar grid type targets while having the additional advantageous features of significantly improving retention time and/or erase time.

Although there has been described a preferred embodiment of this invention, many variations and modifications will now be apparent to those skilled in the art. Therefore, this invention is to be limited, not by the specific disclosure herein, but only by the appended claims. For example the coplanar grid need not form a striped pattern but may be formed of "dots" on the conducting layer which may be rectangular, square, circular, which dots may be arranged in an ordered *m* row by *n* column arrangement. Also the configurations of the grid and conducting layer may be reversed so long as the conducting layer ("stripes", dots, etc. – placed on an insulation layer) are connected in common so as to be at the same level as the target voltage being applied thereto.

What is claimed is:

1. An electronic storage tube for storing images by means of a modulated electron beam, said tube having a target structure including first means substantially unaffected by ionizing radiation which is present during operation of the tube for significantly increasing the image retention time of the target structure wherein said tube comprises:

second means including means for generating an electron beam for applying a signal to the target structure to establish a desired stored charge distribution on the target structure representative of the image to be stored;

third means for detecting the stored charge distribution established on the target structure and wherein said first means comprises a pattern of conducting and insulating areas, said conducting areas being electrically connected to each other to form a conducting member having at least one planar surface;

said insulating areas being formed of a plurality of layers of insulating materials placed on the planar surface of said conducting member;

each of said layers having first and second planar surfaces, the first planar surface of one of said layers being in contact with the planar surface of the conducting member and the second planar surface of said one of said layers being in contact with the first planar surface of another one of said layers;

the second planar surface of the insulating layer furthest removed from said conducting member constituting the surface for storing the charge pattern;

the first planar surface of said last mentioned insulating layer being in contact with the second surface of the insulating layer adjacent thereto;

all of said layers being arranges to overlie portions of said conducting member planar surface while the remaining portions of said conducting member planar surface are exposed to said electron beam;

at least one of said insulating layers being formed of an insulating material whose conductivity is unaffected by the presence of ionizing radiations to prevent the transfer of charge stored on the stored charge surface to significantly increase image retention time of the charge pattern being stored, even after repeated readout.

2. The storage tube of claim 1 further comprising deceleration grid means positioned adjacent said target structure, the interaction of the electron beam with said deceleration grid means creating ionizing radiation in the region of said insulating areas.

3. The invention of claim 1 wherein the target structure has a pattern comprised of a plurality of alternating insulating and conducting stripes.

4. The invention of claim 1 wherein the conducting member comprises a conducting substrate of silicon and the insulating areas overlie and are supported by the conducting substrate such that a pattern of conducting and insulating areas is formed thereby.

5. The invention of claim 4 wherein the pattern comprises a plurality of discrete insulating areas surrounded by exposed surface areas of the conducting substrate.

6. An electronic storage tube for storing images by means of a modulated electron beam, said tube having a target structure including first means substantially unaffected by ionizing radiation which is present during operation of the tube for significantly increasing the image retention time of images stored by the target structure wherein said tube comprises;

second means including means for generating an electron beam for applying a signal to the target structure to establish a desired stored charge distribution on the target structure representative of the image to be stored;

third means for detecting the stored charge distribution established on the target structure and wherein said first means comprises a pattern of conducting and insulating areas, said conducting areas being electrically connected to each other to form a conducting member having at least one planar surface;

said insulating areas being formed of a plurality of layers of insulating materials placed on the planar surface of said conducting member;

said conducting member comprising a continuous layer having first and second planar surfaces and having openings therein;

each of said insulating layers having first and second planar surfaces;

first and second surfaces of a first one of said insulating layers being respectively in contact with one planar surface of said conducting layer and the first surface of another one of said insulating layers;

the insulating layer furthest removed from the conducting member having its first surface in contact with the second surface of the next adjacent insulating layer;

portions of the first surface of said first one of said insulating layers being positioned across said openings and constituting the surface areas for receiving said stored charge patterns;

all of said layers being arranged to overlie portions of said conducting member one planar surface while the remaining portions of said conducting member planar surface are exposed to said electron beam;

at least one of said insulating layers being formed of an insulating material whose conductivity is unaffectd by the presence of ionizing radiation to prevent the transfer of charge stored on the stored charge surface to significantly increase image retention time.

7. The electronic storage tube of claim 1 wherein said second means further comprises means for erasing the stored charge pattern on said stored charge surface; one of said insulating layers being comprised of an insulating material resistant to ionizing radiation, and the other layer being comprised of an insulating material having a significantly lower capacitance than that of said a radiation resistant material to substantially reduce the time required to alter the desired charge distribution.

8. The invention of claim 1, wherein one insulating layer is comprised of silicon dioxide, and the other insulating layer is comprised of a material selected from the group comprising silicon nitride, aluminum oxide and silicon oxy-nitride.

* * * * *